US008882242B2

(12) United States Patent
Beier et al.

(10) Patent No.: US 8,882,242 B2
(45) Date of Patent: Nov. 11, 2014

(54) SYSTEM FOR PRINTING ON AN OBJECT

(71) Applicant: Heidelberger Druckmaschinen AG, Heidelberg (DE)

(72) Inventors: Bernard Beier, Ladenburg (DE); Uwe Ernst, Mannheim (DE); Helge Grandt, Reilingen (DE); Heiner Pitz, Weinheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 13/853,212

(22) Filed: Mar. 29, 2013

(65) Prior Publication Data

US 2013/0257984 A1 Oct. 3, 2013

(30) Foreign Application Priority Data

Mar. 29, 2012 (DE) ..... 10 2012 006 370

(51) Int. Cl.

| | |
|---|---|
| ***B41J 29/393*** | (2006.01) |
| ***B41J 23/00*** | (2006.01) |
| ***B41J 2/135*** | (2006.01) |
| ***B41J 3/407*** | (2006.01) |

(52) U.S. Cl.

CPC ..... *B41J 2/135* (2013.01); *B41J 3/4073* (2013.01)

USPC ..... 347/37; 347/19

(58) Field of Classification Search

CPC ..... B41J 2/135

USPC ..... 347/19, 37

See application file for complete search history.

(56) References Cited

U.S. PATENT DOCUMENTS

| | | | | |
|---|---|---|---|---|
| 4,844,947 | A | 7/1989 | Kasner et al. | |
| 4,980,839 | A * | 12/1990 | Souji et al. | 700/245 |
| 5,132,702 | A | 7/1992 | Shiozaki et al. | |
| 7,275,799 | B2 * | 10/2007 | Hayashi et al. | 347/19 |
| 7,357,959 | B2 | 4/2008 | Bauer | |
| 7,981,462 | B2 | 7/2011 | Büstgens | |
| 8,366,260 | B2 | 2/2013 | Gauss et al. | |
| 2004/0036725 | A1 | 2/2004 | Ikeda et al. | |
| 2008/0225066 | A1 * | 9/2008 | Yorimoto et al. | 347/14 |
| 2009/0167817 | A1 | 7/2009 | Orr | |
| 2010/0253728 | A1 * | 10/2010 | Yoshida et al. | 347/14 |
| 2013/0140952 | A1 | 6/2013 | Kamijo et al. | |
| 2013/0141564 | A1 | 6/2013 | Miyazawa | |

FOREIGN PATENT DOCUMENTS

| | | | |
|---|---|---|---|
| DE | 3140486 | A1 | 5/1982 |
| DE | 3737455 | A1 | 5/1988 |

(Continued)

*Primary Examiner* — Jason Uhlenhake

(74) *Attorney, Agent, or Firm* — Laurence A. Greenberg; Werner H. Stemer; Ralph E. Locher

(57) ABSTRACT

A system for printing an image, preferably a multicolor halftone image, onto at least one non-planar area of a surface of an object, for example a section of a body of a vehicle, includes an inkjet print head having nozzles, a robot, preferably an articulated robot, creating a primary movement, the primary movement including at least two printing paths of the inkjet print head being lateral to each other, and a device creating a secondary movement, the secondary movement being substantially perpendicular to the primary movement and causing the printing paths to laterally adjoin each other. As a result, undesired streaks between the printing paths may advantageously be reduced or prevented.

9 Claims, 4 Drawing Sheets

(56) References Cited

FOREIGN PATENT DOCUMENTS

| | | | |
|---|---|---|---|
| DE | 69005185 | T2 | 4/1994 |
| DE | 10031030 | A1 | 1/2002 |
| DE | 10202553 | A1 | 8/2003 |
| DE | 10390349 | B4 | 12/2010 |
| DE | 102010004496 | A1 | 7/2011 |
| EP | 2065206 | A1 | 6/2009 |
| GB | 2107614 | A | 5/1983 |

* cited by examiner

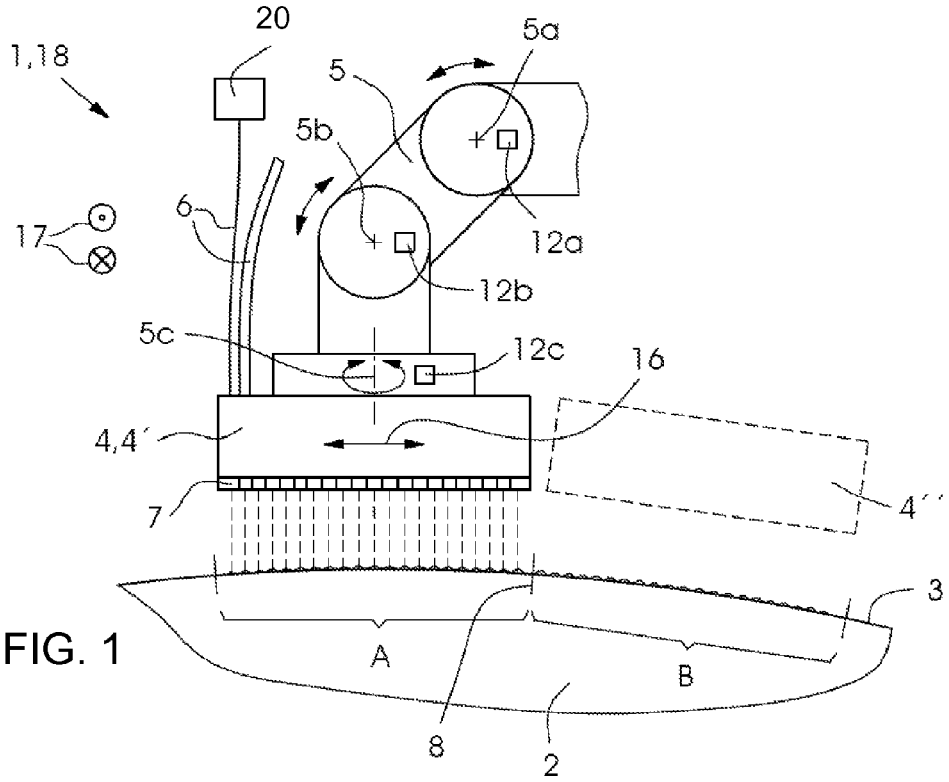
FIG. 1
FIG. 2
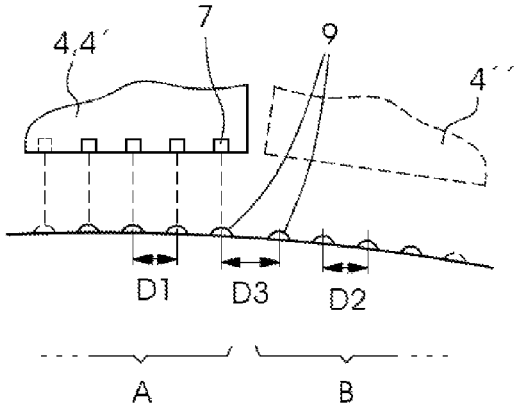

SYSTEM FOR PRINTING ON AN OBJECT

CROSS-REFERENCE TO RELATED APPLICATION

This application claims the priority, under 35 U.S.C. §119, of German Patent Application DE 10 2012 006 370.9, filed Mar. 29, 2012; the prior application is herewith incorporated by reference in its entirety.

BACKGROUND OF THE INVENTION

Field of the Invention

The present invention relates to a system for printing on an object, in which an image is printed on at least one non-planar region of a surface of the object.

It is known in the prior art to print non-planar regions of a surface of an object, for example on curved portions of a body of a vehicle, using an ink-jet print head and to create any desired multicolor image on the surface. For that purpose, the print head is guided along the surface of the object at a defined distance from the surface by a robot, for example an articulated robot. In the process, droplets of ink discharged by the print head are placed at the desired locations to create the desired image. Since the surface of the object is generally much larger than the extension of the print head, it is necessary to guide the print head multiple times across the surface along printing paths to build up the desired printed image out of adjacent printing paths. Adjacent printing paths need to be joined in such a way as to avoid optically visible disruptions at the edges of the printing paths. For example, if there is too much space between a first printing path and a second printing path, the result may be a visible streak between the two printing paths that affects the printed image. Another risk is that there may be too much overlap between the two printing paths. That may likewise result in a visible streak between the two printing paths that may have a negative effect on the printed image. Such defects in the printed image may be the result of insufficient accuracy of the mechanical components for guiding the print head. They may also result from centrifugal forces that act on the print head during its movement, causing the droplets to be mispositioned on the surface.

German Patent Application DE 102 02 553 A1, corresponding to U.S. Pat. No. 7,981,462, for example, discloses moving an application device including spray nozzles in a manual, semi-automated or fully automated way along the surface of an object, for example a building or a public/civil engineering site, and thus applying any desired image to the surface. The first step is to detect and digitize the surface of the object. Then the image to be printed is virtually superimposed on the digitized surface. When the application device prints on the surface, the position of the application device needs to be accurately known. For that purpose, a number of measuring processes are suggested, for example measurements in the field of distance and/or angle measurement technology, telemetry and imaging measurement technology. The positioning error of the measured position value is used in a range check routine. No ink is discharged when the positioning error exceeds an acceptance threshold.

German Patent DE 103 90 349 B4, corresponding to U.S. Pat. No. 7,981,462, by the same applicant further describes that the application of ink is prevented when the application of the corresponding ink or varnish has already been completed at the position of the ink application element.

In contrast, German Translation DE 690 05 185 T2 of European Patent EP 0 396 855 B1, corresponding to U.S. Pat. No. 5,132,702, and U.S. Patent Application Publication No. 2004/0036725 A1 disclose two methods for influencing the drop speed and the drop size of the ink droplets coming from inkjet print heads by the type of pulse applied to piezoelectric actuators of the print head. The variables are, for example, pulse length, pulse amplitude (voltage) and pulse shape. For example, the specification of that U.S. application describes how a preliminary pulse may specifically influence the volume and discharge direction of an ink droplet that is subsequently released by the actual pulse. In that way, it becomes possible to discharge individual ink droplets from the nozzle opening at an angle and thus to apply them to a different location on the surface of the object to be printed, than without such a preliminary pulse.

German Patent Application DE 31 40 486 A1, corresponding to UK Patent Application GB 2,107,614, discloses a device for coating objects such as glass bottles with a synthetic material. For that purpose the device includes a nozzle head having multiple nozzles distributed thereon to discharge a synthetic material in the form of successive droplets. Furthermore, driving devices or drivers are provided to bring about a relative movement between the object surface to be coated and the nozzle head. With respect to the direction of relative movement, the nozzles are disposed in such a way as to ensure that the tracks of synthetic material emerging from adjacent nozzles overlap on the object. However, as described above, such an overlap may cause visible defects in the printed image because too much ink is applied, thus having a detrimental effect on the desired printed image.

German Patent Application DE 37 37 455 A1, corresponding to U.S. Pat. No. 4,844,947, discloses a device and a method for creating ink patterns, for example stripes, on vehicle bodies. The application of ink may be achieved by using a print head disposed on a robot that guides the print head along the surface of the object to be printed. The print head has multiple spray nozzles. The width of the stripe to be printed may be changed by varying the number and distribution of the currently active spray nozzles. The position of a stripe in a direction perpendicular to the movement of the print head may be changed by moving the entire print head by using the robot. Another way of changing the position of the stripe is to activate varying numbers of spray nozzles. In that way, a fine-adjustment of the position of the stripe may be achieved, which is then superimposed to the control by the robot, representing an improved way of applying stripes.

SUMMARY OF THE INVENTION

It is accordingly an object of the invention to provide a system for printing on an object, which overcomes the hereinafore-mentioned disadvantages of the heretofore-known systems of this general type, which prints an image onto at least one non-planar surface area of the object and which avoids the formation of streaks when printing in multiple printing paths or at least reduces the formation of streaks to such an extent that the remaining streaks are not perceived as detrimental to the image.

With the foregoing and other objects in view there is provided, in accordance with the invention, a system for printing an image onto at least one non-planar surface area of an object. The system comprises an inkjet print head having nozzles, a robot creating a primary movement, the primary movement including at least two printing paths of the inkjet print head being lateral to each other, and a device creating a secondary movement, the secondary movement being substantially perpendicular to the primary movement and causing the printing paths to laterally adjoin each other.

Due to the provision of the device for creating secondary movements in the system of the invention it is advantageously possible to compensate positional deviations of the inkjet print head, i.e. deviations of the actual position from the nominal position required to print an image without defects, during the primary movement. This may eliminate or sufficiently reduce undesired visible streaks between the printing paths. The term "laterally adjoining" in this context means that the edges of the individual printing paths are located precisely adjacent each other without too great a gap between the edges and without too much overlap, thus sufficiently reducing or eliminating any streaks that are too pale or too dark in the region of the edges of the printing paths. The primary movement generated by the robot is preferably a movement of the inkjet print head, which passes through multiple printing paths that are located laterally to each other in the same direction or in an opposing direction. For example, a first printing path may be printed during a forward movement of the print head across the surface of the object and a second, adjoining printing path may be created in a backward movement next to the first printing path. Alternatively, a provision may be made for the print head to be inactive during its backward movement and to be moved forward in a direction parallel to the first printing path. The robot may be an articulated robot or a gantry robot.

In accordance with another advantageous feature of the system of the invention, a provision is made for the device to include a piezoelectric actuator or an electro-mechanical component and for the secondary movement to be a movement of the inkjet print head. The piezoelectric actuator acts on the inkjet print head as a whole and causes the latter to carry out the secondary movement as a compensatory movement in a direction perpendicular to the primary movement.

In accordance with a further preferred feature of the system of the invention, the device may include a piezoelectric actuator and the secondary movement may be a movement of at least one nozzle of the inkjet print head. In accordance with this refinement, it is not the print head as a whole but only at least one nozzle that is moved in a direction perpendicular to the primary movement. The at least one nozzle, a nozzle group or all nozzles may be movably received on the inkjet print head so that the secondary movement caused by the piezoelectric actuator is a relative movement with respect to the inkjet print head.

In accordance with an added advantageous feature of the system of the invention, the secondary movement may be neither a movement of the print head as a whole nor of individual nozzles of the print head, but that in accordance with a preferred refinement of the system of the invention, the device includes a piezoelectric actuator and the secondary movement is a movement of at least the drops of one nozzle of the inkjet print head. The piezoelectric actuator is not the piezoelectric actuator that generates the drop but a different piezoelectric actuator that is separate therefrom.

In accordance with an additional advantageous feature of the system of the invention, the device includes a detector detecting the actual position of print dots of a first printing path, the device includes a computer that calculates a deviation between the actual positions of the print dots and their nominal positions and, as the secondary movement, the device generates a compensatory movement on the second printing path that substantially compensates the deviation. In other words, the compensatory secondary movement (compensating potential undesired streaks) occurs on the basis of a nominal-actual comparison of print dots that have already been printed.

In accordance with yet another advantageous feature of the system of the invention, the device may include at least one detector, the robot may be an articulated robot, and the detector may include a rotary encoder detecting the angular position of a joint of the articulated robot. If the articulated robot includes multiple joints, preferably a detector is provided on each joint so that the spatial position of the robot and, in particular, of the print head received on the robot may be accurately determined as an actual position. If this actual position deviates from a predetermined nominal position, a corrective movement of the robot may be effected. The corrective movement acts as a compensatory secondary movement (compensating potential undesired streaks). Alternatively, acceleration sensors, inclination sensors, gyrometers may be used to detect the spatial coordinates of the print head, if desired in chronological sequence.

In accordance with yet a further advantageous feature of the system of the invention, the detector may include an optical sensor or an ultrasound sensor directed towards the surface of the object. For example, the sensor may detect image dots that have previously been printed onto the surface and, based thereon, may determine an edge of the printing path that has previously been printed. In this context it is advantageous if at least the inks that are supplied to nozzles close to the edges are inks that are easy to detect by the detector.

In accordance with yet a further particularly advantageous aspect, special additives may be used in the printing ink, for example additives that have a fluorescent characteristic and the fluorescent light of which may be detected by the detector with high precision. Thus, in accordance with a further advantageous refinement of the system of the invention, a provision may be made for the optical sensor to be directed towards print dots on the surface that have already been printed and to detect the fluorescent radiation thereof. In this way it becomes possible to accurately detect the edge of a previously printed printing path and to accurately align the edge of a printing path yet to be printed with the detected edge so as to avoid or reduce undesired streaks.

In accordance with yet an added advantageous feature of the system of the invention, a so-called tracking system may be used to determine the position of the inkjet print head. This means that information on the current actual spatial position of the print head is continuously available and spatial corrective movements in the form of secondary movements (compensating potential undesired streaks) may be continuously implemented. The tracking system tracks a specific point of the print head or a mark thereon and determines its spatial path. Alternatively, three laser pointers having beams (that are preferably at right angles to each other) which generate light dots on the surrounding walls or on detection screens provided for that purpose may be provided on the print head. The movements of these light dots may be detected by a camera and may be used to calculate the current position of the print head.

In accordance with a concomitant advantageous feature of the system of the invention, the device may include a detector that detects the actual positions of print dots of a first printing path, a computer that calculates the deviation of the actual positions of the print dots from the nominal positions thereof and, as a secondary movement, the device may generate a lateral displacement of the image to be printed relative to the nozzles that substantially compensates the deviation. An advantage of this refinement is that for the secondary movement, no components of the print head are moved. Instead, only the image is displaced in that a print dot is not printed by a first nozzle, for example, but by a second nozzle adjacent the first nozzle. As a result, the print dot is offset by one or more printing nozzles on the surface of the object without having to move the print head or the nozzle themselves. Since the process does not require the movement of any mass, such compensatory movements can be implemented very quickly and may even take place in real time, depending on the computing capacity of the required computer.

Other features which are considered as characteristic for the invention are set forth in the appended claims.

Although the invention is illustrated and described herein as embodied in a system for printing on an object, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 1 is a fragmentary, diagrammatic, side-elevational view of a preferred exemplary embodiment of a system according to the invention; and FIGS. 2 to 8 are enlarged, fragmentary, sectional views of various preferred exemplary embodiments of a system of the invention.

DETAILED DESCRIPTION OF THE INVENTION

Figure 3:
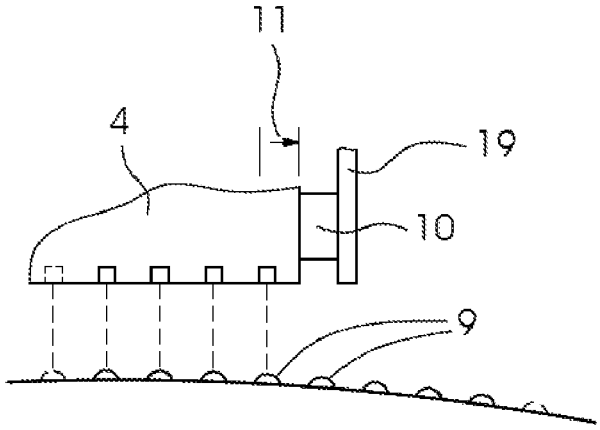

Referring now in detail to the figures of the drawings, in which corresponding elements bear identical reference symbols, and first, particularly, to FIG. 1 thereof, there is seen a system 1 for printing on a three-dimensional object 2 having a non-planar surface 3. The system includes a print head 4 (for example a Spectra Galaxy JA 256/80 AAA) received on an articulated robot 5 (for example a Kuka KR 60-3). In the illustrated example, the robot 5 has three joints 5*a*, 5*b*, 5*c* through which the robot 5 moves the print head 4 along the surface 3 of the object 2. An ink and data connection 6 connects the print head 4 to an ink supply and a computer 20. The connection 6 includes ink supply lines and signal lines for individual nozzles 7 of the print head 4.

FIG. 1 further illustrates the print head 4 in a position 4' printing a printing path A onto the surface 3 of the object 2. The movement of the robot 5 and of the print head 4 is directed into or out of the plane of the drawing in a primary movement 17. The figure further shows that in a position 4", the print head has previously printed a printing path B onto the surface 3 of the object 2. In the process, the print head 4 is likewise moved into or out of the plane of the drawing. Respective edges of the two printing paths A and B adjoin each other at a location 8 on the surface 3 in such a way that there is no unprinted gap and no overlap between the two printing paths. The individual printing paths A and B may be printed in one pass (single pass printing) or in multiple passes (multi-pass printing).

During operation, the robot 5 and the print head 4 received thereon may deviate from their current nominal position, causing the printing path A to be applied at a distance from the printing path B or to overlap the printing path B. In both cases, undesired visible streaks at the location 8 may be the result. The invention helps to avoid such defects. The following FIGS. 3 to 8 illustrate advantageous refinements of the system of the invention that eliminate or reduce precisely such defects.

To begin with, FIG. 2 is an enlarged view of such a defect. The figure shows the print head in its two positions 4' and 4" and individual print dots 9 (or rather halftone dots of the printed image, for example in an AM or FM screen) of the printing paths A and B. It is discernible that a respective average distance D1 between print dots in the printing path A and D2 between print dots in the printing path B is approximately identical, whereas a distance D3 between the two print dots 9 on respective edges of the printing paths A and B is greater than the distances D1 and D2. A person looking at an object 2 that has been printed in this way would realize a pale streak that disturbs the image between the two printing paths A and B. Since the print dots are formed by dots that are discharged from nozzles 7 of the print head 4 and need to travel through a certain dropping distance, for example approximately 1 cm, from the nozzle to the surface 3, the positions of the print dots 9 on the surface 3 are not accurately predictable. In this respect, the distances D1, D2 and D3 are only average values. It is possible to place the print dots of the printing paths A and B close to each other and thus to create a full tone area.

A practical and preferred example is as follows: The drop size of the drops 9 (average diameter) on the surface 2 is approximately 100 micrometers. The distance between the centers of the drops 9 is likewise approximately 100 micrometers. The variation of the points of impact and the positional accuracy of the robot 5 are likewise approximately 100 micrometers. Thus, the generation of a secondary movement on this order of magnitude may reduce or prevent the formation of undesired streaks.

FIG. 3 illustrates a system according to the invention including a print head 4 and a piezoelectric actuator 10 disposed between the print head 4 and a mounting 19 of the robot 5. The piezoelectric actuator 10 causes the print head 4 to be movable relative to the robot 5 or rather to the mounting 19. The piezoelectric actuator receives control signals through the connection 6 of the print head 4. These control commands result in a compensatory movement as a secondary movement 16 (see FIG. 1) carried out by a device 18. As a result of a vibration of the piezoelectric actuator 10, this compensatory movement causes an amount of offset 11 of the print head 4, resulting in a displacement of the two print dots 9 on the edges of the respective printing path A and B relative to each other in such a way that the distance between them corresponds to the average distance between the print dots of the respective printing paths. The control signals for the piezoelectric actuator 10 are supplied by a computer that calculates the required amount of offset 11 based on the actual position of the print head 4 currently detected and the nominal position of the print head 4 and sends a corresponding control signal to the piezoelectric actuator. The actual position required for the calculation may be detected by a detector. For example, rotary encoders 12*a*, 12*b*, 12*c* (see FIG. 1) may be provided to detect the respective angular positions of the joints 5*a*, 5*b*, 5*c*, which may then be used to establish the current actual position of the print head 4.

The vibrations of the piezoelectric actuator 10 cause the points of impact of the drops or the print dots 9 to vary. In the preferred example, these variations may preferably range between 10 and 100 micrometers. The vibrations may correspond to white noise. The vibrations may be periodical over time, yet in this case they need to be in a non-integer relationship with the cycle frequency at which the print dots 9 are created.

The amplitude of the disturbance of the print head 4 caused by the piezoelectric actuator 10 corresponds to the amplitude of the variation of the point of impact of the drops if the secondary movement 16 is located in the plane of the print head 4, for example on the bottom side thereof.

Figure 4:
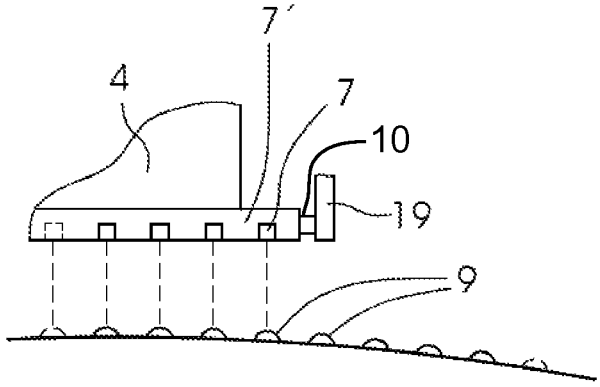

FIG. 4 illustrates a further embodiment in which the piezoelectric actuator 10 is not disposed on the print head 4 but between a nozzle carrier 7' for the individual inkjet nozzles 7 and a mounting 19. The piezoelectric actuator 10, which is supplied with control commands by a computer, allows the compensatory movement as a relative movement of the nozzle carrier 7' so that the print dots 9 on the edges of the respective printing paths A and B are at the desired distance for streak-free printing.

Figure 5:
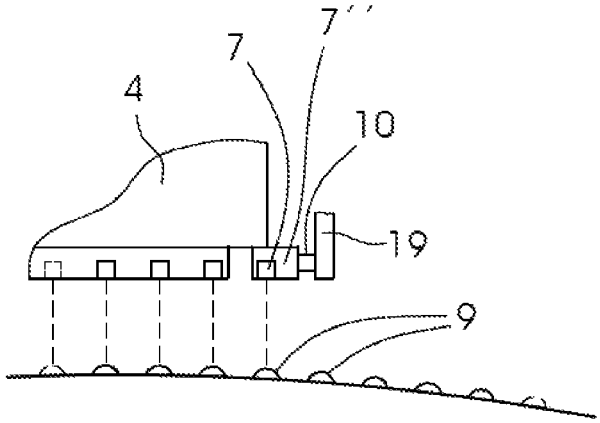

The embodiment shown in FIG. 5 likewise includes a piezoelectric actuator 10. However, the piezoelectric actuator 10 of FIG. 5 is disposed on a nozzle carrier 7" that only includes one nozzle 7. The nozzle 7 prints a print dot 9, which comes to rest on an edge of printing path A. Corresponding control signals for compensating the actual position relative to the nominal position of the print head 4 cause the piezoelectric actuator 10 to carry out a secondary movement 16 as a compensatory movement. Due to this secondary movement of the nozzle 7, the print dot 9 created by this nozzle is placed at a distance from a print dot 9 of the adjacent printing path B, enabling streak-free printing between the two printing paths A and B.

Figure 6:
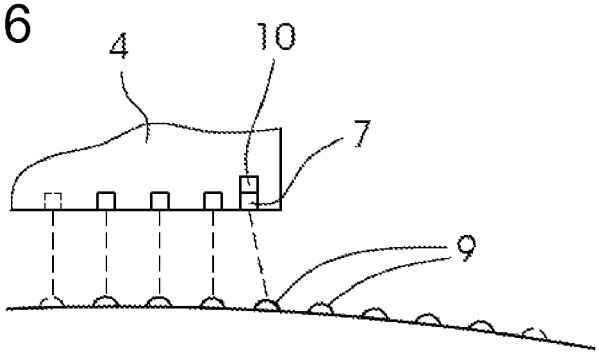

The embodiment shown in FIG. 6 likewise includes a piezoelectric actuator 10. The piezoelectric actuator 10 shown in FIG. 6 is coupled to a nozzle 7 located on the edge of the print head 4 in such a way that when the piezoelectric actuator 10 is actuated as a result of a corresponding control signal, the print dot 9 to be printed by the nozzle is offset at an angle to correct the distance from an adjacent print dot 9 of the previously printed printing path B to ensure streak-free printing. As shown in FIG. 6, the separate piezoelectric actuator 10 is capable of influencing the trajectory of the ink drop that will form the ink dot 9 of the printing path A in such a way that the falling direction of the drop is not perpendicular to the bottom side of the print head 4 but at an angle $\neq 90°$. If this process is applied, however, care must be taken to ensure that the corrected print dot 9 actually reduces potential streaks rather than create new streaks within the printing path A. Under the given circumstances, this may be achieved by offsetting the printing dot 9 of the printing path A far enough to ensure that no streaks that are due to varying distances between the print dots are visible on the right side or on the left side (with reference to the drawing shown in FIG. 6) of the print dot 9. The piezoelectric actuator may likewise be used to create statistical variations of the trajectories (and/or of the sizes) of successive ink drops to achieve a certain blurring on the edges of the printing path that reduces or eliminates undesired streaks.

Figure 7:
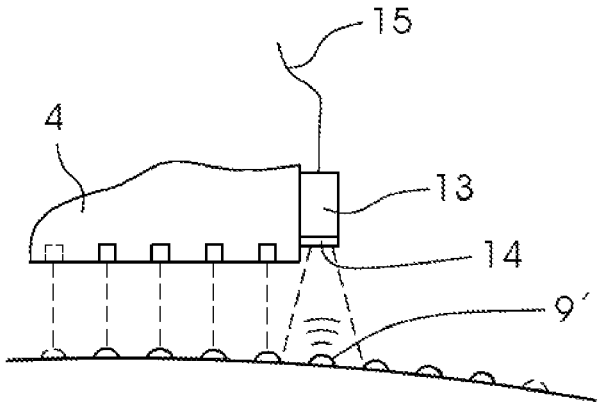

FIG. 7 illustrates a further preferred exemplary embodiment of the system of the invention in which a camera 13 is used. A print dot 9' located on the edge of the previously printed printing path B was printed using a special ink. This ink may, for example, contain special additives that may be activated and have a fluorescent characteristic. Through the use of the camera 13 and, if desired, a band pass filter 14 provided in front of the camera 13, the fluorescent light of the print dot 9' located on the edge may be detected. Based on the positions of the individual print dots 9' located on the edge of the printing path B, a non-illustrated computer connected to the camera 13 by a line 15 may calculate the position of the edge of the printing path B and may use the calculated position to calculate correction values for a secondary movement 16 of the print head 4 when the printing path A is printed. These correction values may be supplied to the device that initiates the secondary movement through the connection 6 shown in FIG. 1. Such devices may be the embodiments shown in FIGS. 3 to 6 including respective piezoelectric actuators 10.

Figure 8:
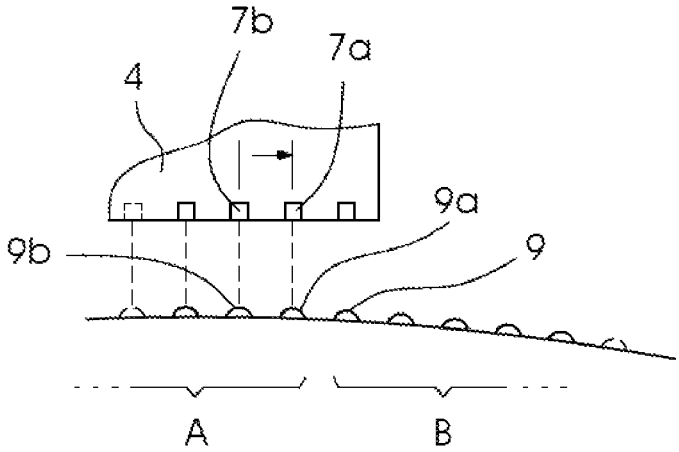

A further preferred exemplary embodiment is shown in FIG. 8. When the printing path A is printed, the illustrated print head 4 is guided with a certain amount of overlap with the previously printed printing path B. A print dot 9*a* that would be printed by a nozzle 7*b* if no correction was made is now printed by an adjacent nozzle 7*a* using correction values. As a result, the print dot 9*a* is closer to a print dot 9 on the edge of the previously printed printing path B, thereby permitting streak-free printing. The correction required for this purpose may, for instance, rely on detection by a camera 13 (as shown in FIG. 7). The edge of the printing path B that is detected by the camera is used by a non-illustrated computer to correct the association of nozzles and print dots. For example, if it is found that without correction the distance between the print dots located on the edges of the two printing paths would be too great, the print dots of the printing path A are moved closer to the print dots of the printing path B. This may be done, for example, by having respective adjacent nozzles print the print dots as shown by the offset 11 for the print dot 9*a* and the two nozzles 7*a* and 7*b* in FIG. 8 as described above. However, if it is found that there would be too much overlap between the print dots of the respective printing paths A and B, the print dots are moved in the opposite direction by the correction, i.e. the print dots of the printing path A are printed by adjacent nozzles in such a way that their distance from the printing path B is increased.

In accordance with an alternative configuration, a provision is made for the print head in the multi-pass mode to be moved at different speeds for different passes. This results in a secondary movement caused by the varying trajectories of the drops.

In accordance with a further alternative configuration for multi-pass printing, not all print dots in the area of the edge are printed in the first pass. The gaps between the print dots of the first pass are filled in a second pass or in further passes. As a result, the strips practically mesh with each other and there are no straight edges between them.

The invention claimed is:

1. A system for printing an image onto at least one non-planar area of a surface of an object, the system comprising:

an inkjet print head having nozzles;

a robot generating a primary movement including at least two printing paths of said inkjet print head located laterally to each other; and a device generating a secondary movement occurring substantially perpendicular to said primary movement and causing said printing paths to laterally adjoin each other;

said device including a detector detecting actual positions of print dots of a first path of said printing paths;

said device including a computer calculating a deviation between actual positions of the print dots and nominal positions thereof; and said device configured to generate a compensatory movement, as said secondary movement, on a second printing path of said printing paths, during said primary movement, to substantially compensate said deviation between said actual and nominal positions.

2. The system according to claim 1, wherein said device includes a piezoelectric actuator and said secondary movement is a movement of said inkjet print head.

3. The system according to claim 1, wherein said device includes a piezoelectric actuator and said secondary movement is a movement of at least one of said nozzles of said inkjet print head.

4. The system according to claim 1, wherein said device includes a piezoelectric actuator and said secondary movement is a movement of at least drops from one of said nozzles of said inkjet print head.

5. A system for printing an image onto at least one non-planar area of a surface of an object, the system comprising:

an inkjet print head having nozzles;

a robot generating a primary movement including at least two printing paths of said inkjet print head located laterally to each other; and a device generating a secondary movement occurring substantially perpendicular to said primary movement and causing said printing paths to laterally adjoin each other;

said device including at least one detector;

said robot being an articulated robot having joints;

said at least one detector including a rotary encoder detecting an angular actual position of one of said joints of said articulated robot; and said device configured to compensate deviations of said actual position from a nominal position of said inkjet print head during said primary movement.

6. The system according to claim 1, wherein said detector includes an optical sensor or an ultrasound sensor directed towards the surface of the object.

7. The system according to claim 6, wherein said optical sensor is directed towards print dots that have already been printed onto the surface of the object and detects fluorescent radiation thereof.

8. The system according to claim 1, wherein said detector includes a tracking system tracking a position of said inkjet print head.

9. A system for printing an image onto at least one non-planar area of a surface of an object, the system comprising:

an inkjet print head having nozzles;

a robot generating a primary movement including at least two printing paths of said inkjet print head located laterally to each other; and a device generating a secondary movement occurring substantially perpendicular to said primary movement and causing said printing paths to laterally adjoin each other;

said device including a detector detecting actual positions of print dots of a first path of said printing paths;

said device including a computer calculating a deviation between the actual positions of the print dots and nominal positions thereof; and said device configured to generate a lateral offset of the image to be printed relative to said nozzles, as said secondary movement, during said primary movement, to substantially compensate the deviation between the actual and nominal positions.

* * * * *